US009392372B2

(12) United States Patent
Fukuoka et al.

(10) Patent No.: US 9,392,372 B2
(45) **Date of Patent: *Jul. 12, 2016**

(54) ACOUSTIC GENERATOR, ACOUSTIC GENERATION DEVICE, AND ELECTRONIC DEVICE

(71) Applicant: KYOCERA Corporation, Kyoto-shi, Kyoto (JP)

(72) Inventors: Shuichi Fukuoka, Kirishima (JP); Noriyuki Kushima, Kirishima (JP); Takeshi Hirayama, Kirishima (JP); Tooru Takahashi, Kagoshima (JP); Yutaka Makino, Kirishima (JP); Atsushi Ishihara, Kirishima (JP); Hiroshi Ninomiya, Kirishima (JP); Kenji Yamakawa, Kirishima (JP); Kentarou Miyazato, Kirishima (JP)

(73) Assignee: Kyocera Corporation, Kyoto-shi, Kyoto (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/404,366

(22) PCT Filed: May 31, 2013

(86) PCT No.: PCT/JP2013/065293
§ 371 (c)(1),
(2) Date: Nov. 26, 2014

(87) PCT Pub. No.: WO2014/024551
PCT Pub. Date: Feb. 13, 2014

(65) Prior Publication Data

US 2015/0172823 A1 Jun. 18, 2015

(30) Foreign Application Priority Data

Aug. 10, 2012 (JP) ..... 2012-179065
Sep. 29, 2012 (JP) ..... 2012-218931
Dec. 28, 2012 (JP) ..... 2012-286794

(51) Int. Cl.
*H04R 17/00* (2006.01)
*B06B 1/06* (2006.01)

(Continued)

(52) U.S. Cl.
CPC ..... *H04R 17/00* (2013.01); *B06B 1/0611* (2013.01); *G10K 11/002* (2013.01); *H04R 1/00* (2013.01); *H04R 7/04* (2013.01); *H04R 2400/11* (2013.01)

(58) Field of Classification Search
CPC ..... H04R 2440/00–2440/07; H04R 17/02; H04R 2217/00–2217/03; H04R 7/04
USPC ..... 381/152, 173, 190, 431
See application file for complete search history.

(56) References Cited

U.S. PATENT DOCUMENTS 3,786,202 A 1/1974 Schafft
4,654,554 A * 3/1987 Kishi ..... 381/190

(Continued)

FOREIGN PATENT DOCUMENTS

EP 1988742 A1 11/2008
JP U-1-65595 U 4/1989

(Continued)

OTHER PUBLICATIONS

International Search Report, PCT/JP2013/065293, Jul. 4, 2013, 1 pg.

(Continued)

*Primary Examiner* — Suhan Ni
(74) *Attorney, Agent, or Firm* — Volpe and Koenig, P.C.

(57) ABSTRACT

An acoustic generator according to an aspect of an embodiment includes a piezoelectric element (exciter), a vibrating body. The piezoelectric element receives an input of an electrical signal and is caused to vibrate. The piezoelectric element is mounted on the vibrating body, and the vibrating body is caused to vibrate by the vibration of the piezoelectric element. The acoustic generator includes at least one pair of two adjacent portions with different stiffnesses in a plan view, and has at least one damper provided contacting with both of the two adjacent portions.

20 Claims, 11 Drawing Sheets

(51) Int. Cl.

| | |
|---|---|
| ***G10K 11/00*** | (2006.01) |
| ***H04R 1/00*** | (2006.01) |
| *H04R 7/04* | (2006.01) |

(56) References Cited

U.S. PATENT DOCUMENTS

| | | | | |
|---|---|---|---|---|
| 6,278,790 | B1 * | 8/2001 | Davis et al. | 381/190 |
| 8,139,795 | B2 * | 3/2012 | Scheel et al. | 381/152 |
| 2003/0048914 | A1 * | 3/2003 | Yi et al. | 381/190 |
| 2003/0121331 | A1 | 7/2003 | Mitsuoka et al. | |
| 2009/0136077 | A1 | 5/2009 | Suzuki et al. | |
| 2011/0002485 | A1 | 1/2011 | Onishi et al. | |
| 2012/0148073 | A1 * | 6/2012 | Kim et al. | 381/190 |
| 2013/0043766 | A1 | 2/2013 | Takahashi et al. | |
| 2013/0322663 | A1 * | 12/2013 | Melcher et al. | 381/190 |

FOREIGN PATENT DOCUMENTS

| | | | |
|---|---|---|---|
| JP | 2006352829 | A | 12/2006 |
| JP | 2009-130663 | A | 6/2009 |
| WO | 2008/147325 | A1 | 12/2008 |
| WO | 2009/110575 | A1 | 9/2009 |
| WO | 2011/074579 | A1 | 6/2011 |

OTHER PUBLICATIONS

Extended European Search Report, European Patent Application No. 13827226.5, Jan. 28, 2016, 9 pgs.

* cited by examiner

ACOUSTIC GENERATOR, ACOUSTIC GENERATION DEVICE, AND ELECTRONIC DEVICE

CROSS-REFERENCE TO RELATED APPLICATIONS

This application is national stage application of International Application No. PCT/JP2013/065293, filed on May 31, 2013, which designates the United States, incorporated herein by reference, and which claims the benefit of priority from Japanese Patent Application No. 2012-179065, filed on Aug. 10, 2012; Japanese Patent Application No. 2012-218931, filed on Sep. 29, 2012; and Japanese Patent Application No. 2012-286794, filed on Dec. 28, 2012, the entire contents of all of which are incorporated herein by reference.

FIELD

The present invention relates to an acoustic generator, an acoustic generation device, and an electronic device.

BACKGROUND

Acoustic generators using an actuator have conventionally known (for example, see Patent Literature 1). Such an acoustic generator outputs sound by applying a voltage to an actuator mounted on a vibrating plate, thereby causing the vibrating plate to vibrate.

CITATION LIST

Patent Literature

Patent Literature 1: Japanese Laid-open Patent Publication No. 2009-130663

SUMMARY

Technical Problem

Because such a conventional acoustic generator actively makes use of the resonance of the vibrating plate, the sound pressure frequency characteristics often indicate peaks (frequencies resulting in a higher sound pressure than those achieved with nearby frequencies) and dips (frequencies resulting in a lower sound pressure than those achieved with nearby frequencies), and it has been therefore difficult to achieve high quality sound.

Solution to Problem

An acoustic generator according to an aspect of an embodiment includes an exciter, a vibrating body. The exciter receives an input of an electrical signal and is caused to vibrate. The exciter is mounted on the vibrating body, and the vibrating body is caused to vibrate by the vibration of the exciter. The acoustic generator includes at least one pair of two adjacent portions with different stiffnesses in a plan view, and has at least one damper provided contacting with both of the two adjacent portions.

DESCRIPTION OF EMBODIMENTS

An acoustic generator, an acoustic generation device, and an electronic device that are examples of some embodiments of the present invention will now be explained in detail with reference to the appended drawings. The embodiments described hereunder are not intended to limit the scope of the present invention in any way.

Figure 1A:
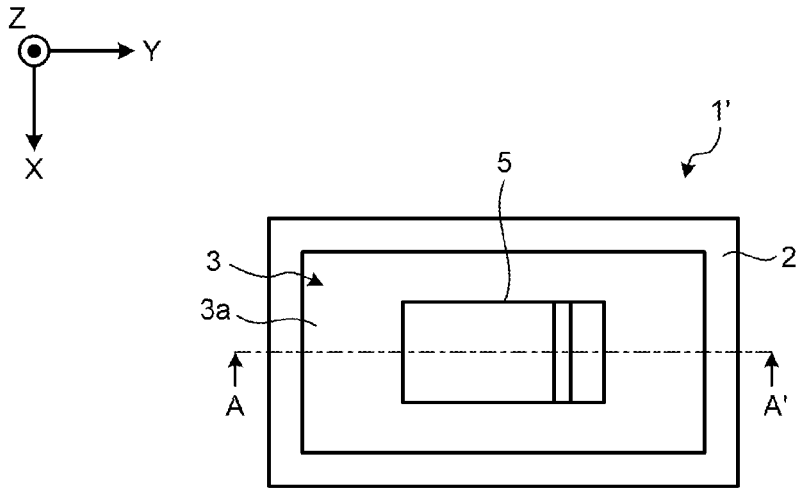
FIG. 1A is a schematic plan view of a basic acoustic generator.

Before explaining an acoustic generator 1 according to the embodiment, a general structure of a basic acoustic generator 1' will now be explained with reference to FIGS. 1A and 1B. FIG. 1A is a schematic plan view of the acoustic generator 1', and FIG. 1B is a cross sectional view along A-A' in FIG. 1A.

Figure 1B:
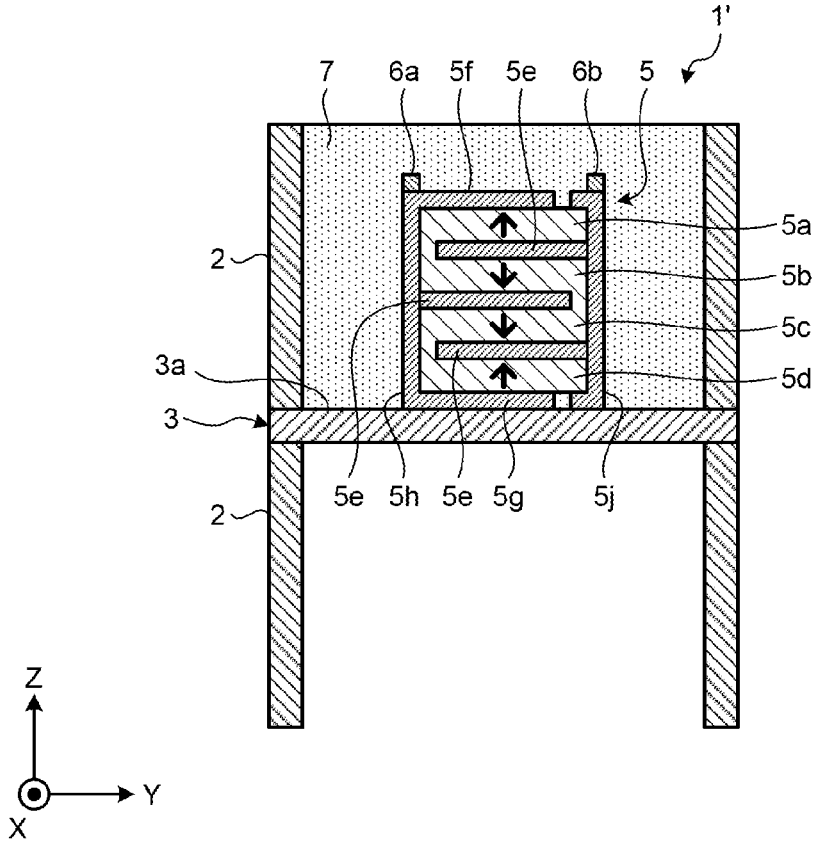
FIG. 1B is a cross sectional view along the line A-A' in FIG. 1A.

To facilitate understanding of the explanation, included in FIGS. 1A and 1B is a three-dimensional Cartesian coordinate system having a Z axis of which positive direction extends perpendicularly upwardly and of which negative direction extends perpendicularly downwardly. This Cartesian coordinate system is included in some of the drawings referred to in the following explanation. A resin layer 7 is omitted in FIG. 1A.

Also to facilitate understanding of the explanation, illustrated in FIG. 1B is the acoustic generator 1' of which thickness direction (Z-axial direction) is exaggeratingly enlarged.

As illustrated in FIG. 1A, the acoustic generator 1' includes a frame 2, a vibrating plate 3, and a piezoelectric element 5. Explained below is an example in which the piezoelectric element 5 is provided in singularity as illustrated in FIG. 1A, unless specified otherwise, but the number of the piezoelectric element 5 is not limited to one.

The frame 2 has two frame members having the same rectangular, frame-like shape, and nipping the ends of the vibrating plate 3 therebetween, thereby allowing the frame 2 to serve as a support for supporting the vibrating plate 3. The vibrating plate 3 has a plate-like or a film-like shape, and of which ends are nipped and fixed by the frame 2. In other words, the vibrating plate 3 is supported in a manner stretched across the frame 2. The inner portion of the vibrating plate 3, being inner with respect to the frame 2, and that is not nipped by the frame 2 and is capable of freely vibrating serves as a vibrating body 3*a*. The vibrating body 3*a* is an approximately rectangular portion that is on the inner side of the frame 2.

The vibrating plate 3 may be made of various types of materials, such as a resin or a metal. For example, the vibrating plate 3 may be a film made of a resin such as polyethylene or polyimide and having a thickness of 10 micrometers to 200 micrometers.

The thickness, the material, and the like of the frame members forming the frame 2 are not particularly limited. The frame members may be made of various types of materials such as a resin or a metal. For example, the frame 2 may be preferably made of stainless steel with a thickness of 100 micrometers to 1000 micrometers, from the viewpoint of mechanical strength and high corrosion resistance.

Illustrated in FIG. 1A is the frame 2 of which internal portion has an approximately rectangular shape, but the shape may also be a polygonal shape such as a parallelogram, a trapezoid, or a regular polygon.

The piezoelectric element 5 is provided bonded to the surface of the vibrating body 3*a*, for example, and serves as an exciter that receives an application of an electrical signal and excites the vibrating body 3*a*.

The piezoelectric element 5 includes a laminate of four piezoelectric layers 5*a*, 5*b*, 5*c*, and 5*d* that are made of ceramic and laminated alternatingly with three internal electrode layers 5*e*, surface electrode layers 5*f* and 5*g* provided on the top and the bottom surfaces of the laminate, respectively, and external electrodes 5*h* and 5*j* provided on respective sides where the internal electrode layers 5*e* are exposed, as illustrated in FIG. 1B. To the external electrodes 5*h* and 5*j*, lead terminals 6*a* and 6*b* are connected, respectively.

The piezoelectric element 5 has a plate-like shape, and of which principal surfaces at the top and the bottom have a polygonal shape such as a rectangle or a square. The piezoelectric layers 5*a*, 5*b*, 5*c*, and 5*d* are polarized in the directions indicated by the arrows in FIG. 1B. In other words, the piezoelectric layers 5*a*, 5*b*, 5*c*, and 5*d* are polarized in opposite directions on one side and the other side in the thickness direction (Z-axial direction in FIG. 1B), with respect to the direction of the electric field applied at a particular moment.

When a voltage is applied to the piezoelectric element 5 via the lead terminals 6*a* and 6*b*, the piezoelectric layers 5*c* and 5*d* on the side bonded on the vibrating body 3*a* deform by shrinking, and the piezoelectric layers 5*a* and 5*b* on the opposite side deform by stretching, for examples, at one particular moment. By applying an alternating-current signal to the piezoelectric element, therefore, the piezoelectric element 5 is caused to bend and vibrate, thereby causing the vibrating body 3*a* to bend and vibrate.

A principal surface of the piezoelectric element 5 is bonded to a principal surface of the vibrating body 3*a* using an adhesive such as epoxy-based resin.

Examples of materials with which the piezoelectric layers 5*a*, 5*b*, 5*c*, and 5*d* are formed include lead-free piezoelectric materials such as lead zirconate titanate (PZT), a Bi-layered ferroelectric compound, a tungsten bronze structure compound, and a piezoelectric ceramic conventionally used.

Various types of metallic materials may be used for the internal electrode layers 5*e*. When a material with a metallic component consisting of silver and palladium, and a ceramic component used in the piezoelectric layers 5*a*, 5*b*, 5*c*, and 5*d*, for example, a stress caused by the difference in the thermal expansions in the piezoelectric layers 5*a*, 5*b*, 5*c*, and 5*d* and the internal electrode layers 5*e* can be reduced, so that the piezoelectric element 5 with no defective lamination can be achieved.

The lead terminals 6*a* and 6*b* may be made of various types of metallic materials. When the lead terminals 6*a* and 6*b* are provided using flexible wiring in which a foil made of a metal such as copper or aluminum is interposed between resin films, for example, a low-profile piezoelectric element 5 can be provided.

The acoustic generator 1' also includes, as illustrated in FIG. 1B, a resin layer 7 that is provided covering the piezoelectric element 5 and the surface of the vibrating body 3*a* on the inner side of the frame 2, and is integrated with the vibrating body 3*a* and the piezoelectric element 5. The resin layer 7 integrated with the vibrating body 3*a* and the piezoelectric element 5 is a layer of resin coupled with the vibrating body 3*a* and the piezoelectric element 5, and integrally vibrating with the vibrating body 3*a* and the piezoelectric element 5.

For the resin layer 7, a material such as a resin, including acrylic-based resin and silicone-based resin, or rubber may be used, and the resin layer 7 is preferably formed in such a manner that a Young's modulus within a range from 1 megapascal to 1 gigapascal is achieved. By embedding the piezoelectric element 5 in the resin layer 7, an appropriate level of damper effect can be achieved, so that the resonance can be suppressed and the peaks and the dips in the sound pressure frequency characteristics can be reduced.

Furthermore, illustrated in FIG. 1B is an example in which the resin layer 7 is provided to the same height as the height of the frame 2, but does not necessarily need to be provided to the same height, as long as the piezoelectric element 5 is embedded in the resin layer 7. For example, the resin layer 7 may be provided to a height that is higher than the height of the frame 2.

In the acoustic generator according to this example illustrated in FIGS. 1A and 1B, the piezoelectric element 5 is mounted on the vibrating body 3*a* and covered by the resin layer 7, and the vibrating body 3*a*, the piezoelectric element 5, and the resin layer 7 are integrated, so that the vibrating body 3*a*, the piezoelectric element 5, and the resin layer 7 vibrate integrally.

In a plan view of the acoustic generator from a direction perpendicular to the principal surfaces of the vibrating body 3*a* (in the thickness direction of the vibrating body 3*a*, and in the Z-axial direction in FIGS. 1A and 1B), there are a plurality of pairs of portions that are adjacent to each other and having different stiffness. These portions with different stiffness are, for example, a portion including the frame 2, a portion only including the vibrating body 3*a* and the resin layer 7 (without including the exciter), a portion including the vibrating body 3*a*, the resin layer 7, and the piezoelectric element 5 (a portion including the exciter), for example, in a plan view of the acoustic generator.

The portion including the vibrating body 3*a*, the resin layer 7, and the piezoelectric element 5 represents a portion where the vibrating body 3*a*, the resin layer 7, and the piezoelectric element 5 are present in a plan view in the direction perpendicular to the principal surfaces of the vibrating body 3*a*. These portions with different stiffness tend to deform largely when the vibrating body 3*a* bends and vibrates.

Hereinafter, when a something is viewed in a plan view, the thing is looked down in the thickness direction of the vibrating body 3*a* (the direction perpendicular to the principal surfaces of the vibrating body 3*a*, and in the Z-axial direction in FIGS. 1A and 1B).

Figure 2:
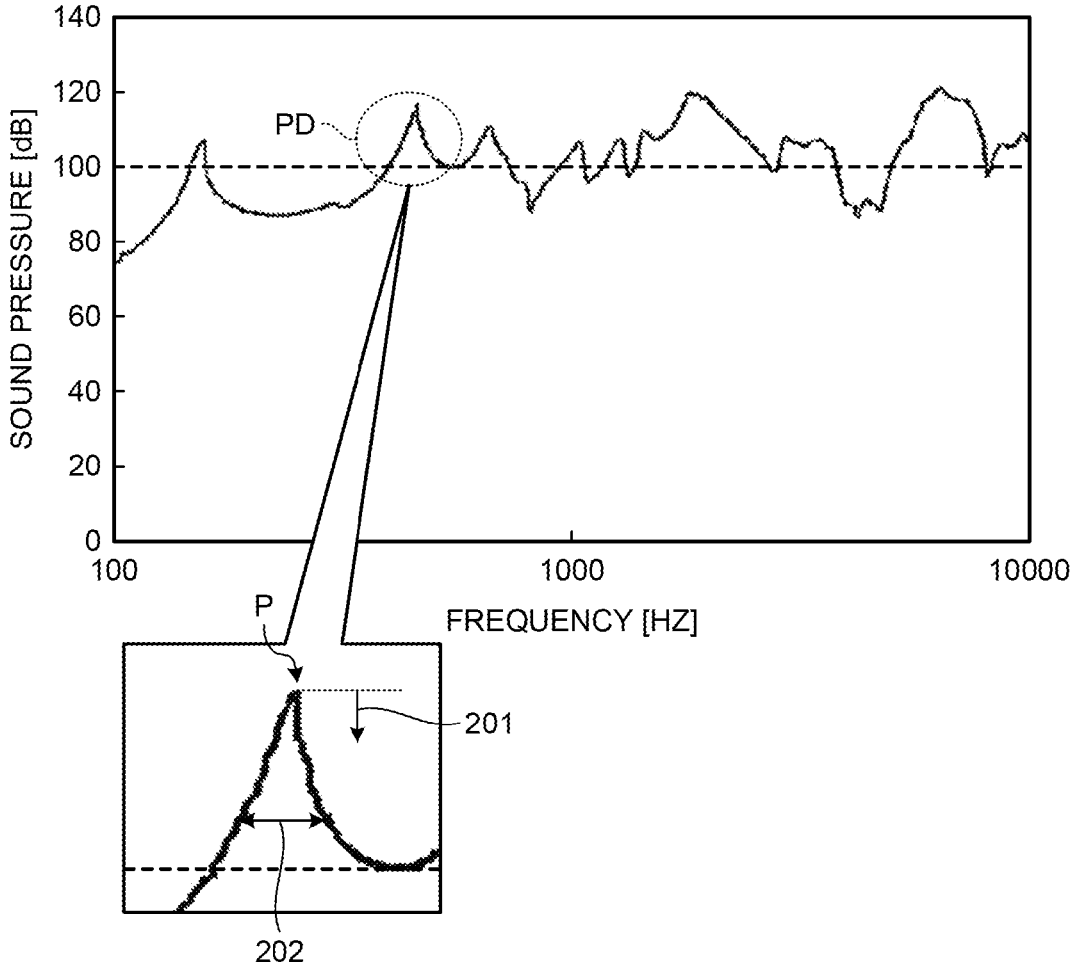
FIG. 2 is a schematic illustrating an example of sound pressure frequency characteristics.

FIG. 2 is a schematic illustrating an example of sound pressure frequency characteristics. When the entire composite vibrating body including the piezoelectric element 5, and consisting of the vibrating body 3*a*, the piezoelectric element 5, and the resin layer 7 is symmetrically configured, as illustrated in FIG. 1A mentioned earlier, for example, the peaks concentrate and degenerate at a certain frequency, as illustrated in FIG. 2, so that the peaks and the dips tend to become steep.

As an example, let us focus on the portion surrounded by the closed curve PD drawn with a dotted line in FIG. 2. With such a peak, the sound pressure becomes varied depending on the frequency, so that it becomes difficult to achieve high-quality sound.

In such a case, it is effective to take an approach of reducing the height of the peak P (see the arrow 201 in FIG. 2), and of increasing the peak width (see the arrow 202 in FIG. 2), as illustrated in FIG. 2, to reduce the peak.

In the embodiment, therefore, the height of the peak P is reduced, to begin with, by providing a damper 8, giving a mechanical vibration loss to the vibrating body 3*a* thereby.

The acoustic generator according to the embodiment has at least one pair of two adjacent portions with different stiffness in a plan view, and is provided with at least one damper 8 that is positioned contacting with both of the two adjacent portions with different stiffness in a plan view. In this manner, the levels of the peaks and the dips in the sound pressure frequency characteristics can be further reduced.

The levels of the peaks and the dips in sound pressure frequency characteristics can also be reduced by providing the damper 8 in a manner contacting with a portion including the exciter (the piezoelectric element 5) and an adjacent portion not including the exciter (the piezoelectric element 5), in a plan view of the acoustic generator.

The levels of the peaks and the dips in sound pressure frequency characteristics can be reduced more effectively by providing the damper 8 straddling the portion including the exciter (the piezoelectric element 5) and the adjacent portion not including the exciter (the piezoelectric element 5) (the portion including the vibrating body 3*a* and the resin layer 7), in a plan view of the acoustic generator.

The levels of the peaks and the dips in sound pressure frequency characteristics can also be reduced by providing the damper 8 in a manner contacting with both of a portion including the support (the frame 2) and an adjacent portion not including the support (the frame 2) (portion including the vibrating body 3*a* and the resin layer 7), in a plan view of the acoustic generator.

The levels of the peaks and the dips in sound pressure frequency characteristics can be reduced more effectively by providing the damper 8 straddling the portion including the support (the frame 2) and the adjacent portion not including the support (the frame 2) (portion including the vibrating body 3*a* and the resin layer 7), in a plan view of the acoustic generator.

The damper 8 is preferably mounted on the surface of the resin layer 7 provided in a manner covering the exciter (the piezoelectric element 5) and the vibrating body 3*a* on which exciter (the piezoelectric element 5) is mounted, and integrated with the vibrating body 3*a* and the exciter (the piezoelectric element 5). In this manner, the damper effect can be improved, and the damper can be mounted easily. By providing the damper 8 in a manner contacting with none of the vibrating plate 3 and the exciter (the piezoelectric element 5) receiving an input of an electrical signal and generating vibration, the levels of the peaks and the dips in the sound pressure characteristics can be reduced, and a reduction in the sound pressure level can be suppressed across a wide range of frequencies.

Figure 3A:
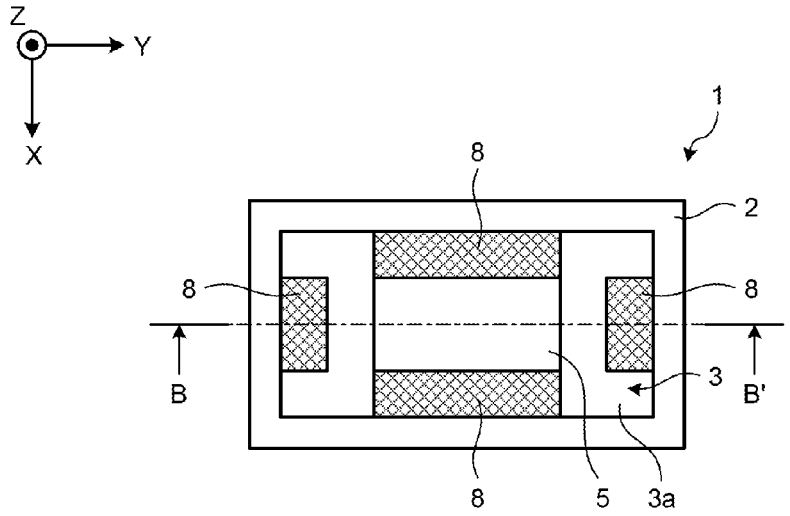
FIG. 3A is a schematic plan view illustrating a structure of an exemplary acoustic generator according to one embodiment of the present invention.
Figure 3B:
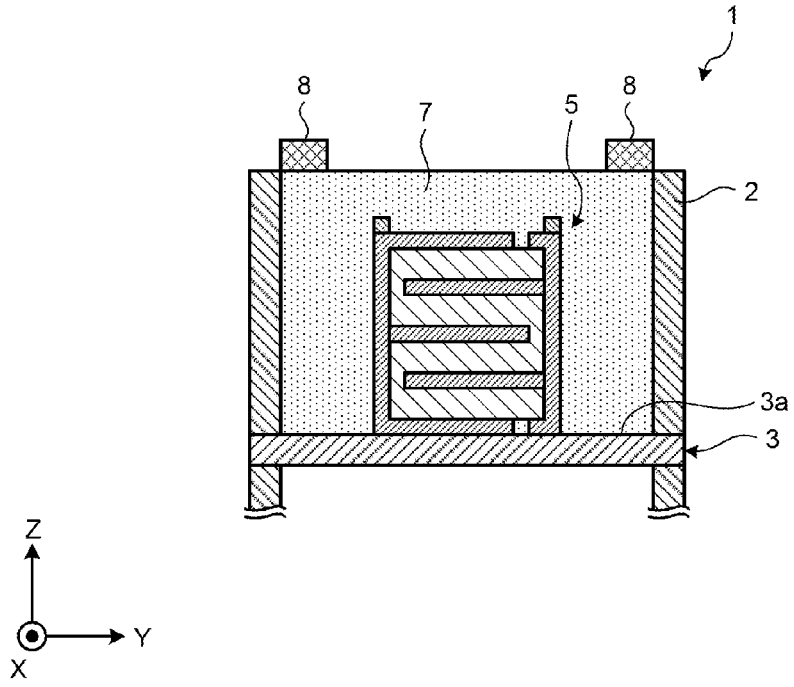
FIG. 3B is a schematic sectional view along the line B-B' in FIG. 3A.
Figure 4A:
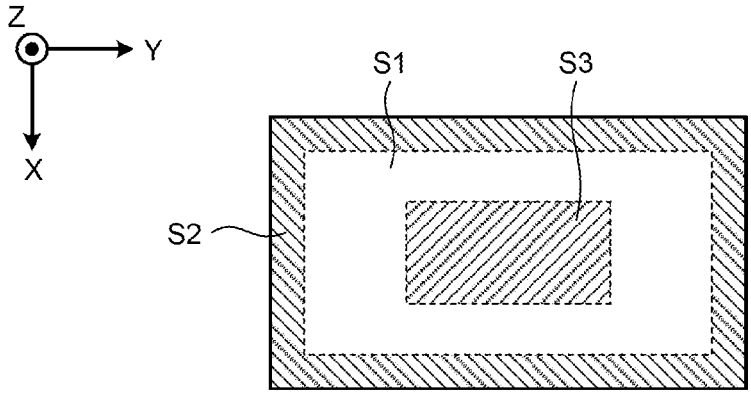
FIG. 4A is a first schematic for explaining a layout of a damper in the acoustic generator in a plan view.
Figure 4B:
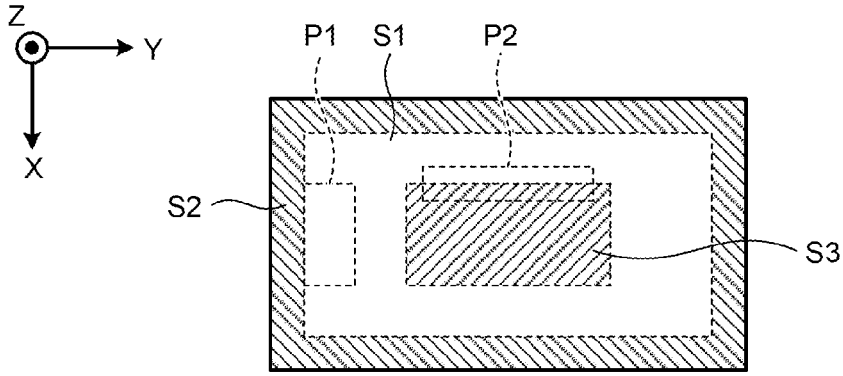
FIG. 4B is a second schematic for explaining the layout of the damper in the acoustic generator in a plan view.
Figure 4C:
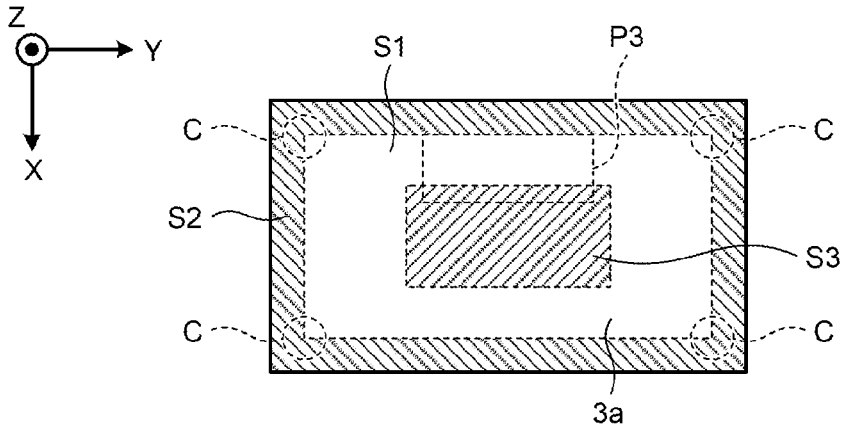
FIG. 4C is a third schematic for explaining the layout of the damper in the acoustic generator in a plan view.

The damper layout will now be explained specifically with reference to FIGS. 3A to 4C. FIG. 3A is a schematic plan view illustrating a structure of an exemplary acoustic generator 1 according to the embodiment. FIG. 3B is a schematic sectional view along the line B-B' in FIG. 3A. FIGS. 4A to 4C are first to third schematics for explaining layouts of the damper 8, in a plan view of the acoustic generator 1.

As illustrated in FIG. 3A, the acoustic generator 1 includes the dampers 8, in addition to the elements included in the acoustic generator 1' illustrated in FIGS. 1A and 1B. In the example illustrated FIG. 3A, four dampers 8 having an approximately rectangular shape are provided, but the shape and the number of the dampers 8 are not limited thereto.

Each of the dampers 8 may be any member that gives a mechanical loss, but is preferably a member of which mechanical loss coefficient is high, that is, of which mechanical quality factor (what is called a mechanical Q) is low.

Such dampers 8 may be made of various types of elastic materials, but because it is preferable for the dampers 8 to be soft and to deform easily, the dampers 8 is preferably made of a rubber material such as urethane rubber, or a soft resin material such as a silicone resin.

A porous rubber material such as urethane foam is particularly preferable. The dampers 8 are mounted on the surface of the resin layer 7 illustrated in FIG. 1B, and are integrated with the vibrating body 3*a*, the piezoelectric element 5, and the resin layer 7.

By providing the dampers 8 in the manner described above, the portions of the vibrating body 3*a* where the dampers 8 are mounted become subject to a vibration loss attributable to the dampers 8 via the resin layer 7, and the resonance is suppressed thereby.

The damper 8 is provided contacting with both of the portions with different stiffness stretching in the surface direction of the vibrating plate 3. The "adjacent portions with different stiffness" will now be explained.

As illustrated in FIG. 4A, in a plan view of the acoustic generator 1 (looking down on the acoustic generator 1 in the +z direction in FIG. 4A), the acoustic generator 1 can be generally divided into a portion S1 including the vibrating body 3*a* and the resin layer 7, a portion S2 including the frame 2, a portion S3 including the piezoelectric element 5, the resin layer 7, and the vibrating body 3*a*, for example. These portions S1 to S3 have different stiffness, depending on whether the portion includes the frame 2 or the piezoelectric element 5.

To simplify the explanation using FIGS. 4A to 4C, the portions with different stiffness are simply illustrated as a combination of rectangles. To also simplify the explanation, each of these portions is also assumed to have the same stiffness across the entire portion.

The "adjacent portions with different stiffness" are, for example, the portion S1 and the portion S2, or the portion S1 and the portion S3. A portion near the border between the adjacent portions with different stiffness tends to deform largely when the vibrating body 3*a* bends and vibrates, because of the difference in the stiffness. In the acoustic generator 1 according to the embodiment, therefore, the dampers 8 are provided contacting with a portion that deforms largely, so that the peaks and the dips can be reduced more effectively.

For example, in the embodiment, as illustrated in FIG. 4B, in a plan view of the acoustic generator 1, the damper 8 is provided in a layout pattern P1 in which the damper 8 is positioned contacting with at least a part of the border between the portion S1 and the portion S2 (in other words, a part of the outline of the vibrating body 3*a*). In the layout pattern P1, the damper 8 may also be positioned contacting with at least a part of the border between the portion S1 and the portion S3 (in other words, a part of the outline of the portion including the piezoelectric element 5 in a plan view).

In the embodiment, the damper 8 is also provided in a layout pattern P2 in which the damper 8 is positioned straddling the portion S1 and the portion S3, that is, straddling at least a part of the border between the portion S1 and the portion S3 (in other words, a part of the outline of the portion including the piezoelectric element 5 in a plan view). In the layout pattern P2, the damper 8 may be provided straddling the portion S1 and the portion S2, that is, straddling at least a part of the border between the portion S1 and the portion S2 (in other words, a part of the outline of the vibrating body 3*a*).

In the embodiment, the damper 8 is also provided in a layout pattern P3 in which the damper 8 comes in contact with both of the portion S1 and the portion S2, and in contact with both of the portion S1 and the portion S3, in a plan view of the acoustic generator 1, as illustrated in FIG. 4C.

By providing the dampers 8 in a combination of the layout patterns P1 to P3, the mechanical vibration loss attributable to the dampers 8 can be efficiently given to portions that deforms largely, so that the peaks and the dips can be reduced more effectively.

In this manner, by reducing the peaks and the dips in the resonance frequency, excellent sound pressure frequency characteristics that vary smoothly can be achieved.

The four corners of the vibrating body 3*a* and the nearby portions that are illustrated as surrounded by closed curves C drawn in dotted lines in FIG. 4C do not necessarily need to be provided with the dampers 8, because such four corners and the nearby portions are supported by two inner sides of the frame 2, the sides being perpendicular to each other, in a plan view, and deform less easily.

Based on the layout patterns P1 to P3 illustrated in FIGS. 4A to 4C, specific examples of the layout of the damper 8 will now be explained one by one with reference to FIGS. 5A to 8C. In FIGS. 5A to 8C, the members of the acoustic generator 1 including the piezoelectric element 5 are sometimes illustrated in a quite simplified manner.

Figure 5A:
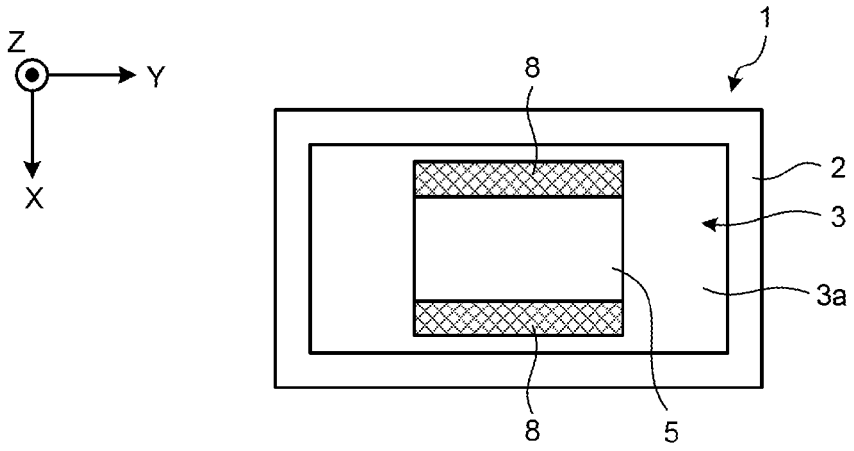
FIG. 5A is a first schematic plan view illustrating a specific example of the damper layout.
Figure 5B:
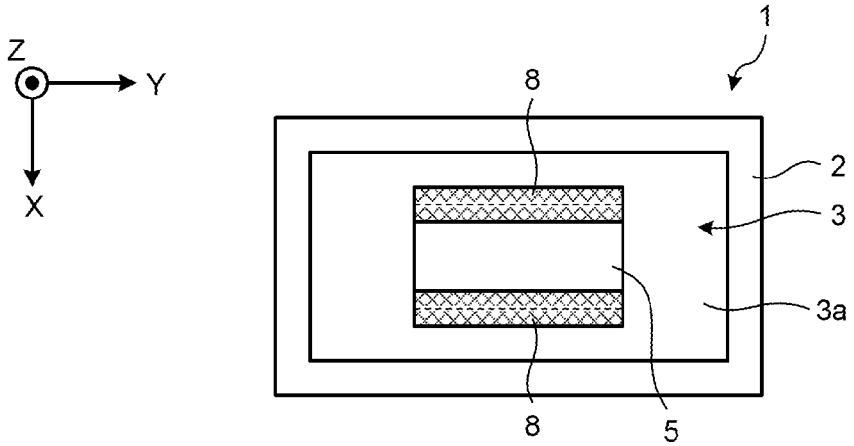
FIG. 5B is a second schematic plan view illustrating a specific example of the damper layout.
Figure 5C:
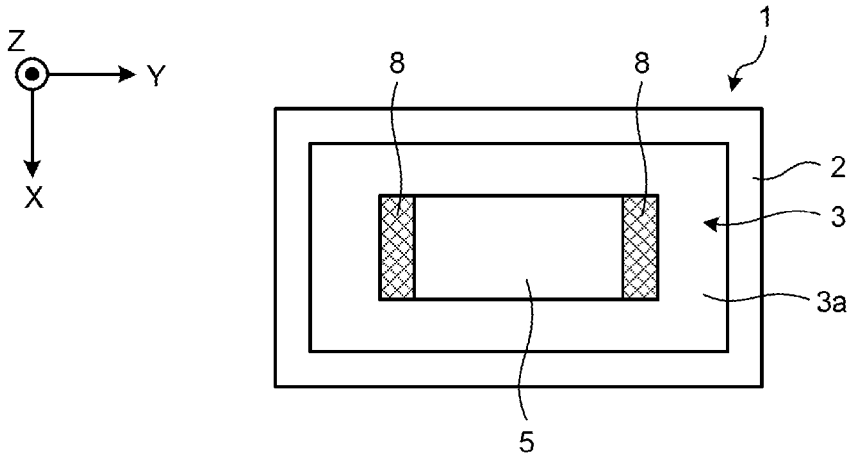
FIG. 5C is a third schematic plan view illustrating a specific example of the damper layout.

FIGS. 5A to 5C are first to third schematic plan views illustrating specific examples of the layout of the dampers 8. As illustrated in FIG. 5A, the dampers 8 may be provided contacting with respective longitudinal sides of the outline of the portion including the piezoelectric element 5 in a plan view. Alternatively, the damper 8 may be provided in singularity along one longitudinal side.

As illustrated in FIG. 5B, the dampers 8 may be provided overlapping with the piezoelectric element 5, straddling the portion including the piezoelectric element 5 and the adjacent portion not including the piezoelectric element 5 in a plan view, that is, straddling the respective longitudinal sides of the outline of the portion including the piezoelectric element 5 in a plan view. Alternatively, one of the pair of the dampers 8 may be positioned overlapping with the piezoelectric element 5, and the other damper 8 may be provided contacting with a longitudinal side.

Illustrated in FIGS. 5A and 5B are layouts in which the dampers 8 are positioned along the respective longitudinal sides of the outline of the portion including the piezoelectric element 5 in a plan view, but it should be needless to say that the dampers 8 may also be provided on respective short-direction sides of the outline of the portion including the piezoelectric element 5 in a plan view, as illustrated in FIG. 5C.

Figure 6A:
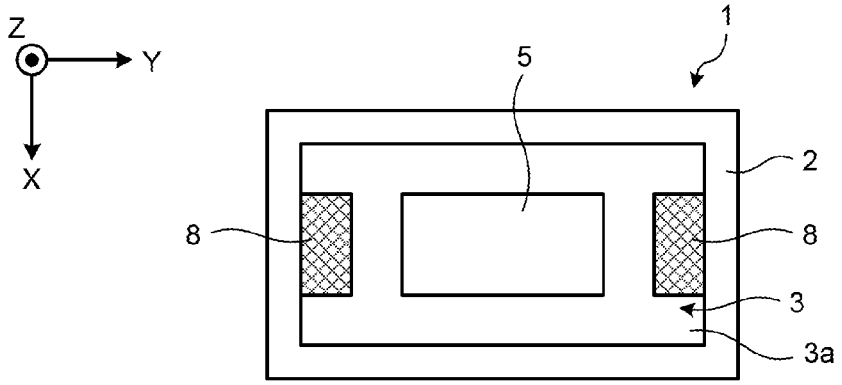
FIG. 6A is a fourth schematic plan view illustrating a specific example of the damper layout.
Figure 6B:
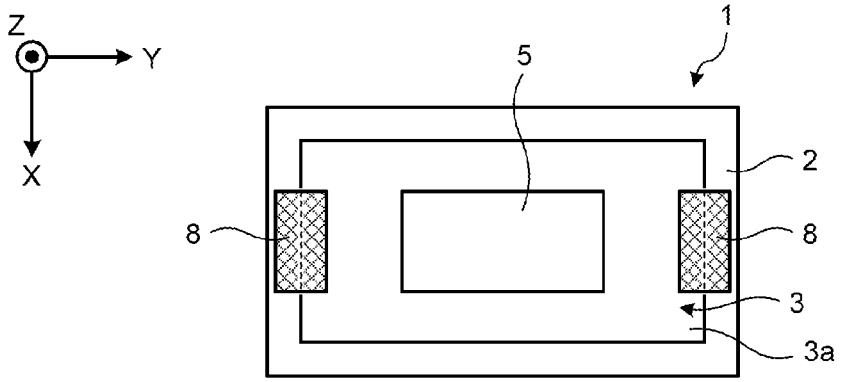
FIG. 6B is a fifth schematic plan view illustrating a specific example of the damper layout.
Figure 6C:
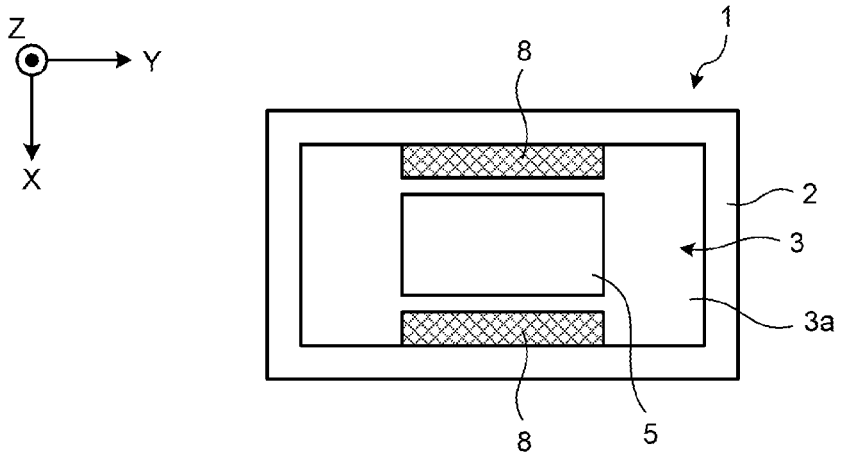
FIG. 6C is a sixth schematic plan view illustrating a specific example of the damper layout.

FIGS. 6A to 6C are fourth to sixth schematic plan views illustrating specific examples of the layout of the dampers 8. As illustrated in FIG. 6A, the damper 8 may be positioned contacting with respective short-direction inner sides of the frame 2. Alternatively, one damper 8 may be provided along one short-direction side.

As illustrated in FIG. 6B, the dampers 8 may be provided overlapping with the frame 2, straddling the portion including the frame 2 and the adjacent portion not including the frame 2 in a plan view, in other words, straddling the respective short-direction inner sides of the frame 2. Alternatively, one of the pair of the dampers 8 may be provided overlapping with the frame 2, and the other damper 8 may be provided contacting with a short-direction side.

Illustrated in FIGS. 6A and 6B are exemplary layouts in which the dampers 8 are positioned along respective short-direction inner sides of the frame 2, but it should be needless to say that the dampers 8 may also be positioned along respective longitudinal sides of the frame 2, as illustrated in FIG. 6C.

Figure 7A:
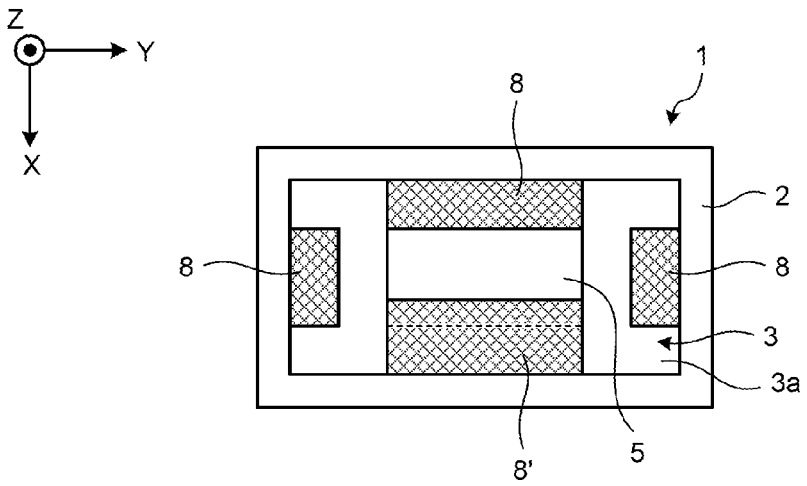
FIG. 7A is a seventh schematic plan view illustrating a specific example of the damper layout.
Figure 7B:
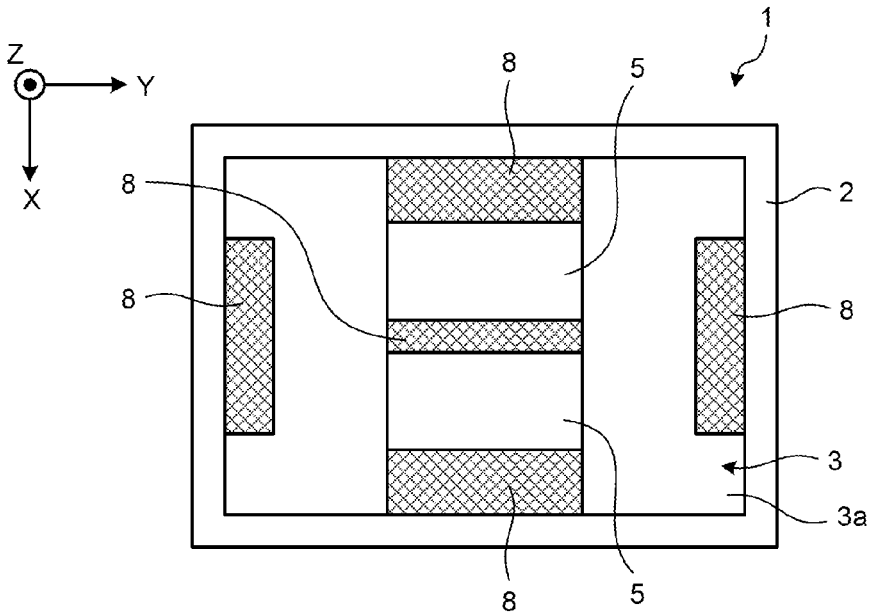
FIG. 7B is an eighth schematic plan view illustrating a specific example of the damper layout.

FIGS. 7A and 7B are seventh and eighth schematic plan views illustrating specific examples of the layout of the dampers 8. By combining the exemplary layouts explained with reference to FIGS. 5A to 6C, for example, four dampers 8 may be provided in a manner surrounding the piezoelectric element 5 provided in singularity, as illustrated in FIG. 7A.

In such a layout, the dampers 8 may be positioned in a manner filling the respective gaps formed between the frame 2 and the piezoelectric element 5 in the short direction of the frame 2, for example, as illustrated in FIG. 7A. Some of the dampers 8 may be positioned overlapping with the piezoelectric element 5 or the like, e.g., as illustrated as a damper 8'.

In the middle- or large-sized acoustic generator 1 having two or more piezoelectric elements 5, as illustrated in FIG. 7B, the dampers 8 may be positioned in a manner filling the respective gaps formed between the frame 2 and the piezoelectric elements 5.

By positioning the dampers 8 in a manner filling the respective gaps formed between the frame 2 and the piezoelectric element 5 along the surface direction of the vibrating plate 3, an appropriate level of damper effect can be achieved even in a structure in which there are successive portions with different stiffness and deforming largely by different degrees, so that excellent sound pressure frequency characteristics can be achieved.

Figure 8A:
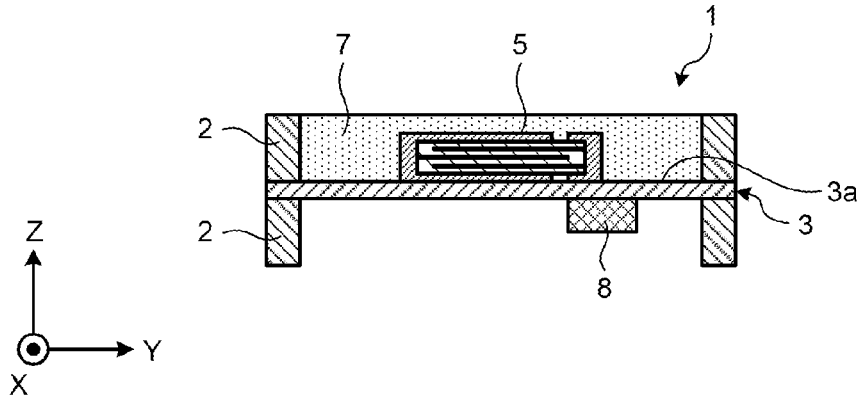
FIG. 8A is a first schematic sectional view illustrating a specific example of the damper layout.
Figure 8B:
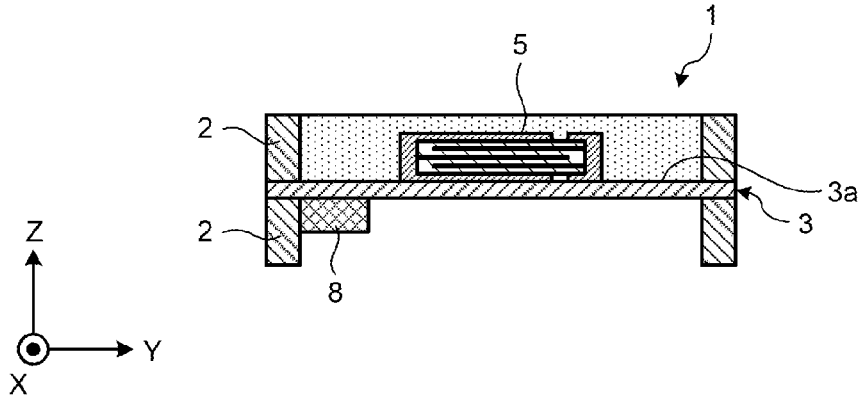
FIG. 8B is a second schematic sectional view illustrating a specific example of the damper layout.
Figure 8C:
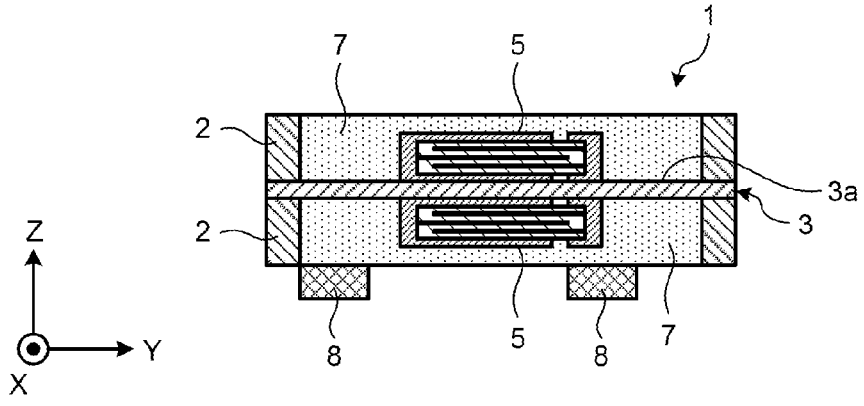
FIG. 8C is a third schematic sectional view illustrating a specific example of the damper layout.

FIGS. 8A to 8C are first to third sectional views illustrating specific examples of the layout of the dampers 8. FIGS. 8A to 8C are sectional views across the line A-A' in the acoustic generator 1 (see FIG. 1A).

As illustrated in FIGS. 8A and 8B, the dampers 8 may be provided on the other principal surface of the vibrating plate 3, on the opposite side of the principal surface on which the piezoelectric element 5 is mounted. In such a case, it is preferable for the dampers 8 to be positioned contacting with both of the adjacent portions with different stiffness in the plan view, in the same manner as described above.

Illustrated in FIG. 8A is an exemplary layout in which the damper 8 is positioned straddling the outline of the portion including the piezoelectric element 5 in a plan view. Illustrated in FIG. 8B is an exemplary layout in which the damper 8 is positioned contacting with the inner wall of the frame 2.

By providing the damper 8 on the principal surface of the vibrating plate 3 on the opposite side of the piezoelectric element 5, the profile of the acoustic generator 1 can be reduced. Furthermore, by providing the damper 8 in a manner directly contacting with the vibrating plate 3 generating sound, the damper effect of the damper can be improved.

When a unimorph piezoelectric element 5 is mounted in a manner nipping the vibrating plate 3 from both sides, as illustrated in FIG. 8C, for example, the resin layer 7 may be formed on the rear surface side of the vibrating plate 3, and the damper 8 may be provided on the surface of the resin layer 7.

Figure 9A:
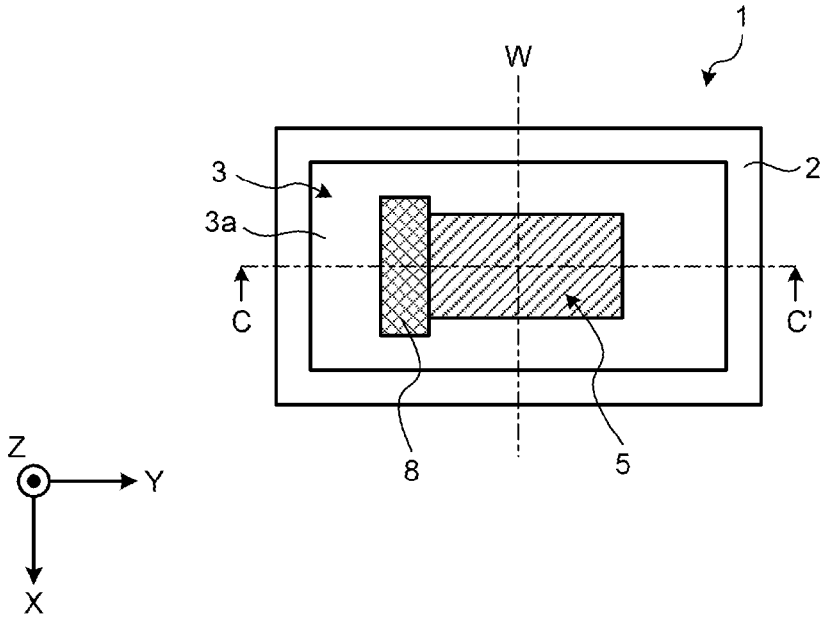
FIG. 9A is a ninth schematic plan view illustrating a specific example of the damper layout.
Figure 9B:
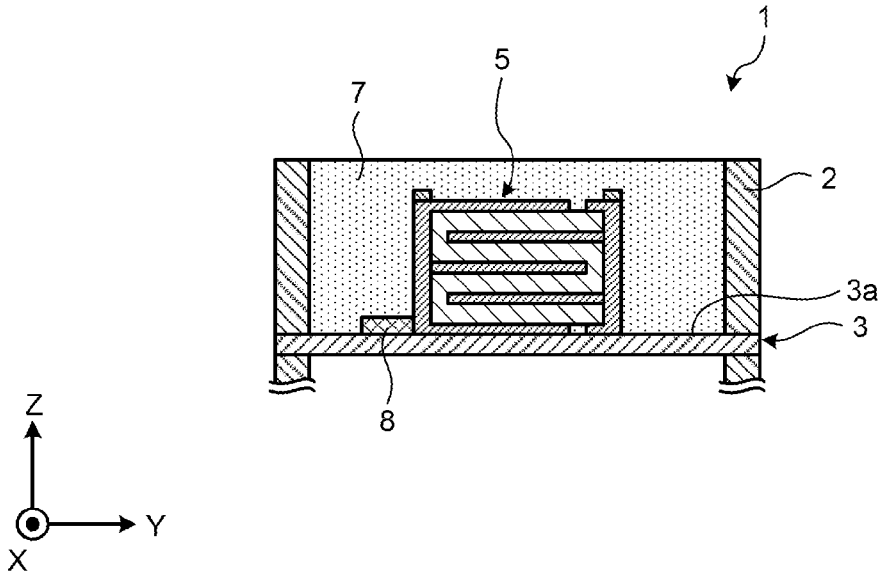
FIG. 9B is a cross sectional view along the line C-C' in FIG. 9A.

FIG. 9A is a ninth plan view illustrating a specific example of the layout of the dampers 8, and FIG. 9B is a sectional view of the acoustic generator 1 along the line C-C' in FIG. 9A.

In FIGS. 9A and 9B, the damper 8 is positioned contacting with both of two adjacent portions with different stiffness (the portion including only the vibrating plate 3 and the resin layer 7 in the thickness direction of the vibrating plate 3, and the portion including the piezoelectric element 5 in addition to the vibrating plate 3 and the resin layer 7 in the thickness direction of the vibrating plate 3) in a plan view. In FIGS. 9A and 9B, the damper 8 is also positioned contacting with both of the vibrating plate 3 and the piezoelectric element 5. By positioning the damper 8 in a manner directly contacting with the piezoelectric element 5 receiving an input of an electrical signal and vibrating, the damper effect of the damper can be improved.

The layout of the damper 8 is not limited to those described above, and the damper 8 may be positioned in various other ways. For example, the damper 8 may be provided in singularity, in a manner contacting with the surface of the resin layer 7 and the surface of the frame 2, and another damper 8 may be provided in the resin layer 7 in a manner contacting with the vibrating body 3*a* and the piezoelectric element 5.

Figure 10A:
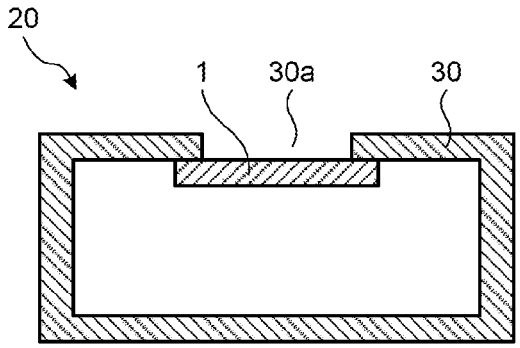
FIG. 10A is a schematic illustrating a configuration of an exemplary acoustic generation device according to an embodiment of the present invention.
Figure 10B:
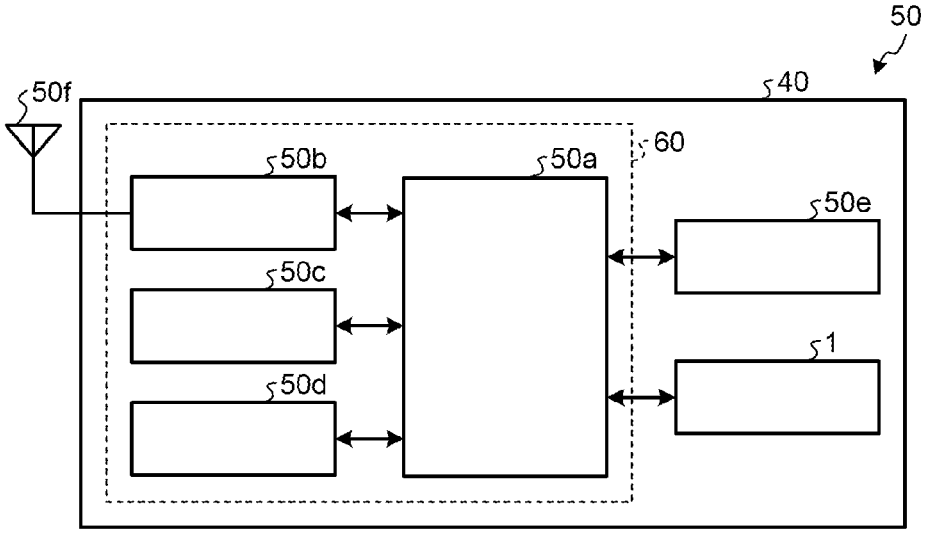
FIG. 10B is a schematic illustrating a configuration of an exemplary electronic device according to an embodiment of the present invention.

Explained now with reference to FIGS. 10A and 10B are an acoustic generation device and an electronic device including the exemplary acoustic generator 1 according to the embodiment explained above. FIG. 10A is a schematic illustrating a structure of an exemplary acoustic generation device 20 according to an embodiment of the present invention, and FIG. 10B is a schematic illustrating a configuration of an exemplary electronic device 50 according to an embodiment of the present invention. In these drawings, only the components required in the explanations are illustrated, and a detailed configuration of and a general components of the acoustic generator 1 are omitted.

The acoustic generation device 20 is an acoustic generator such as what is called a speaker, and includes, for example, a housing 30 and the acoustic generator 1 mounted on the housing 30, as illustrated in FIG. 10A. The housing 30 has a box-like cuboid shape, and an opening 30*a* is formed on one surface of the housing 30. The housing 30 can be made using a known material such as plastic, metal, or wood. The shape of the housing 30 is not limited to a box-like cuboid shape, and may be a different shape, including a cylinder and a truncated cone.

The acoustic generator 1 is mounted on the opening 30*a* on the housing 30. The acoustic generation device 20 having such a structure can resonate the sound generated by the acoustic generator 1 inside of the housing 30, so that the sound pressure in the low-frequency range, for example, can be increased. The location where the acoustic generator 1 is mounted may be set freely. The acoustic generator 1 may be mounted on the housing 30 with another object interposed between the acoustic generator 1 and the housing 30.

The acoustic generator 1 may be installed in different types of electronic devices 50. For example, in FIG. 10B described below, the electronic device 50 is explained to be a mobile electronic device, such as a mobile phone or a tablet terminal.

As illustrated in FIG. 10B, the electronic device 50 includes an electronic circuit 60. The electronic circuit 60 includes, for example, a controller 50*a*, a communication unit 50*b*, a key input unit 50*c*, and a microphone input unit 50*d*. The electronic circuit 60 is connected to the acoustic generator 1, and serves to output an audio signal to the acoustic generator 1. The acoustic generator 1 generates sound based on the audio signal received from the electronic circuit 60.

The electronic device 50 also includes a display unit 50*e*, an antenna 50*f*, and the acoustic generator 1. The electronic device 50 also includes a case 40 in which these devices are housed.

In FIG. 10B, all of these devices, including the controller 50*a*, are illustrated to be housed in one case 40, but the way in which the devices are housed is not limited thereto. In the embodiment, the arrangement of the other components may be set freely as long as at least the acoustic generator 1 is mounted on the case 40 directly or with some object interposed between the acoustic generator 1 and the case 40.

The controller 50*a* is a control unit for the electronic device 50. The communication unit 50*b* exchanges data, for example, via the antenna 50*f*, based on the control of the controller 50*a*.

The key input unit 50*c* is an input device for the electronic device 50, and receives operations of key inputs performed by an operator. The microphone input unit 50*d* is also an input device for the electronic device 50, and receives operations of voice inputs of an operator.

The display unit 50*e* is a display output device for the electronic device 50, and outputs information to be displayed based on the control of the controller 50*a*.

The acoustic generator 1 operates as a sound output device in the electronic device 50. The acoustic generator 1 is connected to the controller 50*a* in the electronic circuit 60, and receives an application of a voltage controlled by the controller 50*a* and outputs sound.

Explained with reference to FIG. 10B is an example in which the electronic device 50 is a mobile electronic device, but the type of the electronic device 50 is not limited thereto, and may be used in various types of consumer devices having a function of generating sound. The electronic device 50 may be a flat television or a car stereo system, for example, and may be provided in various types of products having a function of generating sound or voice, such as a vacuum cleaner, a washing machine, a refrigerator, and a microwave oven.

Mainly explained in the embodiment described above is an example in which the piezoelectric element 5 is provided on one principal surface of the vibrating body 3*a*, but the configuration is not limited thereto, and the piezoelectric element 5 may be provided on both surfaces of the vibrating body 3*a*.

Explained in the embodiment is an example in which the portion on the inner side of the frame has a polygonal shape of which example is an approximately rectangular shape. The shape of the portion is, however, not limited thereto, and may be a circle or an oval.

Furthermore, explained in the embodiment described above is an example in which the resin layer 7 is formed to cover the piezoelectric element 5 and the vibrating body 3*a* in the frame 2, but the resin layer does not necessarily be provided.

Furthermore, explained in the embodiment described above is an example in which the vibrating plate is a thin film such as a resin film, but the vibrating plate is not limited thereto, and the vibrating plate may be a plate-like member, for example.

Furthermore, explained in the embodiment described above is an example in which the support for supporting the vibrating body 3*a* is the frame 2, and supports the ends of the vibrating body 3*a*, but the support is not limited thereto. For example, the support may support only the two ends of the vibrating body 3*a* in the longitudinal direction or the short direction.

Furthermore, explained in the embodiment described above is an example in which the exciter is the piezoelectric element 5, but the exciter is not limited to a piezoelectric element, and may be any exciter having a function of receiving an electrical signal and causing vibration. The exciter may be, for example, an electrodynamic exciter, an electrostatic exciter, or an electromagnetic exciter that are known exciters causing a speaker to vibrate. An electrodynamic exciter applies a current to a coil positioned between magnetic poles of permanent magnets, and causes the coil to vibrate. An electrostatic exciter applies a bias and an electrical signal to two metal plates facing each other, and causes the metal plates to vibrate. An electromagnetic exciter supplies an electrical signal to a coil, and causes a thin steel sheet to vibrate.

The present invention is not limited to the examples explained in the embodiment, and various modifications and improvements are still possible within the scope not deviating from the spirit of the present invention.

EXAMPLE

A specific example of the acoustic generator 1 according to the present invention will now be explained. The exemplary acoustic generator 1 according to the embodiment in which the dampers 8 are provided as illustrated in FIG. 7B, and another acoustic generator according to a comparative example in which none of these dampers 8 are provided were manufactured, and their electrical properties were measured.

To begin with, piezoelectric powder containing PZT of which Zr is partially substituted with Sb, binder, dispersant, plasticizer, and solvent were kneaded for 24 hours in a ball mill, to produce slurry. Green sheets were then produced using the produced slurry with doctor blading. Conductive paste containing Ag and Pd was then applied to the green sheets in a predetermined shape using screen printing, thereby forming a conductor pattern that is to be the internal electrode layer 5*e*. The green sheets formed with the conductor pattern were then laminated with other green sheets and pressed, and a laminated green body was produced thereby. This laminated green body was then degreased in the air at 500 degrees Celsius for 1 hour, and fired at 1100 degrees Celsius for 3 hours, and the laminate was achieved thereby.

The longitudinal end surfaces of acquired laminate were then cut with dicing, and the tips of the internal electrode layers 5*e* were exposed to the side surfaces of the laminate. Conductive paste containing Ag and glass was then applied to both principal surfaces of the laminate with screen printing, and the surface electrode layers 5*f* and 5*g* were formed thereby. Conductive paste containing Ag and glass was then applied to both longitudinal side surfaces of the laminate with dipping, and baked in the air at 700 degrees Celsius for 10 minutes, and the pair of external electrodes 5*h* and 5*j* was formed thereby. In this manner, the laminate was produced. The size of the principal surfaces of the produced laminate had a width of 18 millimeters, and a length of 46 millimeters. The thickness of the laminate was set to 100 micrometers. The piezoelectric layers were then polarized by applying 100-volt voltage for two minutes via the pair of external electrodes 5*h* and 5*j*, and an exciter (piezoelectric element) 5 that is a laminated bimorph piezoelectric element was achieved.

A film (vibrating plate) 3 having a thickness of 25 micrometers and made of polyimide resin was then prepared, and the ends of the film 3 were nipped and fixed between the two frame members making up the frame 2, while tensile force was applied to the film 3. Used as the two frame members for making up the frame 2 were those made of stainless steel, with a thickness of 0.5 millimeters. The size of the film 3 on the inner side of the frame 2 was 110 millimeters in length, and 70 millimeters in width. Two exciters 5 were then bonded at the center of one principal surface of the fixed film 3 in the length direction, using an adhesive made of acrylic resin. The lead terminals 6*a* and 6*b* were then coupled to each of the exciters 5, and wired. Acrylic-based resin having a Young's modulus of 17 megapascals after being solidified was then filled and solidified inside of the frame members on the one principal surface of the film 3, to the same height as the height of the frame members, and the resin layer 7 was formed thereby.

The dampers 8 were then bonded on the surface of the resin layer 7 using an adhesive made of acrylic resin. For the dampers 8, urethane foam with a thickness of 0.25 millimeter was used. The dampers 8 were mounted at the position illustrated in FIG. 7B. The acoustic generator according to the comparative example had the same structure as that described above, except that none of the dampers 8 were provided.

Figure 11A:
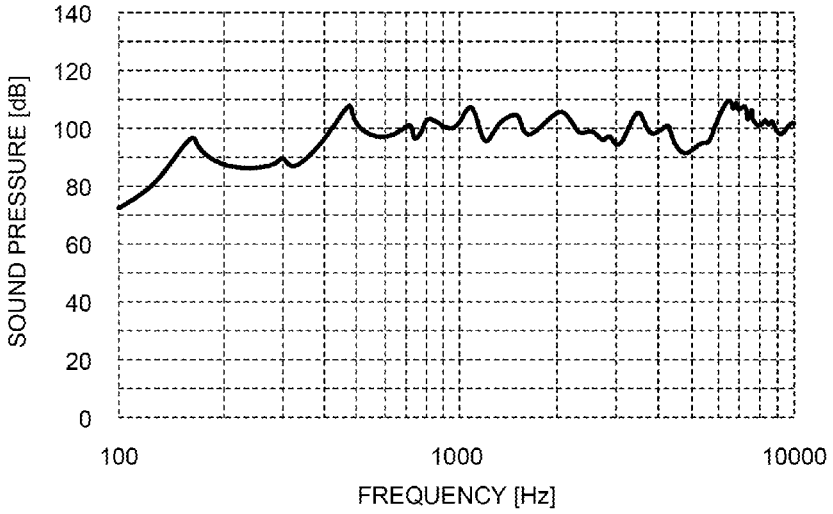
FIG. 11A is a graph illustrating sound pressure frequency characteristics of the exemplary acoustic generator according to the embodiment.
Figure 11B:
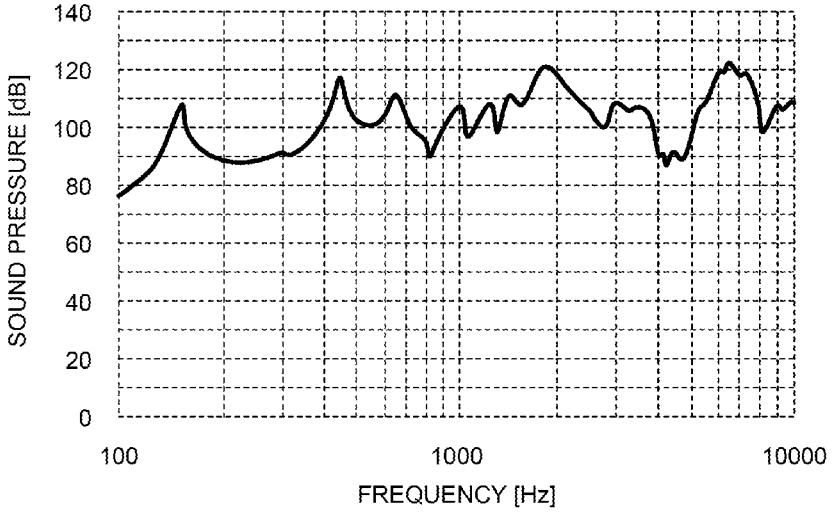
FIG. 11B is a graph illustrating sound pressure frequency characteristics of the acoustic generator according to a comparative example.

The sound pressure frequency characteristics of the produced acoustic generators were measured in accordance with Japan Electronics and Information Technology Industries Association (JEITA) standard EIJA RC-8124A. To make the measurements, a sine-wave signal with an effective voltage of 5 volts was applied between the lead terminals 6*a* and 6*b* of the acoustic generator, and sound pressures were measured by installing a microphone at a point of 0.1 meter above a reference axis of the corresponding acoustic generator. The measurements from the exemplary acoustic generator 1 according to an embodiment of the present invention are illustrated in FIG. 11A, and those from the acoustic generator with no dampers 8 according to the comparative example are illustrated in FIG. 11B. In the graphs in FIGS. 11A and 11B, the horizontal axis represents the frequency, and the vertical axis represents the sound pressure.

Compared with the sound pressure frequency characteristics of the acoustic generator according to the comparative example illustrated in FIG. 11B, the sound pressure frequency characteristics of the exemplary acoustic generator 1 according to the embodiment illustrated in FIG. 11A indicated smoother sound pressure characteristics with smaller peaks and dips. These results confirmed the effectiveness of the present invention.

The invention claimed is:

1. An acoustic generator comprising:

an exciter;

a vibrating body on which the exciter is mounted; and a resin layer provided on the vibrating body so as to cover the exciter, wherein the acoustic generator includes at least one pair of two adjacent portions with different stiffnesses in a plan view, and has at least one damper provided contacting with both of the two adjacent portions.

2. The acoustic generator according to claim 1, wherein one of the pair is a pair of a first portion including the exciter and a second portion not including the exciter in a plan view, and at least one of the damper is provided contacting with both the first portion and the second portion.

3. The acoustic generator according to claim 1, wherein one of the pair is a pair of a first portion including the exciter and a second portion not including the exciter in a plan view, and at least one of the damper is provided straddling both the first portion and the second portion.

4. The acoustic generator according to claim 1, further comprising a resin layer that is provided covering the exciter and a surface of the vibrating body on which the exciter is mounted, and integrated with the vibrating body and the exciter, wherein at least one of the damper is mounted on a surface of the resin layer.

5. The acoustic generator according to claim 1, further comprising a support that supports the vibrating body, wherein one of the pair is a pair of a third portion including the support and a fourth portion not including the support in a plan view, and at least one of the damper is provided contacting with both the third portion and the fourth portion.

6. The acoustic generator according to claim 1, further comprising a support that supports the vibrating body, wherein one of the pair is a pair of a third portion including the support and a fourth portion not including the support in a plan view, and at least one of the damper is provided straddling both the third portion and the fourth portion.

7. The acoustic generator according to claim 1, wherein at least one of the damper is provided contacting with the vibrating body.

8. The acoustic generator according to claim 1, wherein at least one of the damper is provided contacting with the exciter.

9. An acoustic generation device comprising:

a housing; and the acoustic generator according to claim 1 installed in the housing.

10. An electronic device comprising:

a case;

the acoustic generator according to claim 1 installed in the case; and an electronic circuit that is connected to the acoustic generator, wherein the electronic device has a function of causing the acoustic generator to generate sound.

11. The acoustic generator according to claim 1, further comprising a support that supports the vibrating body, wherein one of the pair is a pair of a first portion including the exciter and a second portion not including the exciter in a plan view, another of the pair is a pair of a third portion including the support and a fourth portion not including the support in a plan view, one of the damper is provided contacting with both the first portion and the second portion, and another of the damper is provided contacting with both the third portion and the fourth portion.

12. The acoustic generator according to claim 1, further comprising a support that supports the vibrating body, wherein one of the pair is a pair of a first portion including the exciter and a second portion not including the exciter in a plan view, another of the pair is a pair of a third portion including the support and a fourth portion not including the support in a plan view, one of the damper is provided contacting with both the first portion and the second portion, and the one of the damper is provided contacting with both the third portion and the fourth portion.

13. The acoustic generator according to claim 1, wherein one of the pair is a pair of a first portion including the exciter and a second portion not including the exciter in a plan view, and two or more of the damper is provided contacting with both the first portion and the second portion.

14. The acoustic generator according to claim 1, further comprising a support that supports the vibrating body, wherein one of the pair is a pair of a third portion including the support and a fourth portion not including the support in a plan view, and two or more of the damper is provided contacting with both the third portion and the fourth portion.

15. An acoustic generation device comprising:

a housing; and the acoustic generator according to claim 11 installed in the housing.

16. An acoustic generation device comprising:

a housing; and the acoustic generator according to claim 13 installed in the housing.

17. An electronic device comprising:

a case;

the acoustic generator according to claim 11 installed in the case; and an electronic circuit that is connected to the acoustic generator.

18. An electronic device comprising:

a case;

the acoustic generator according to claim 12 installed in the case; and an electronic circuit that is connected to the acoustic generator.

19. An electronic device comprising:

a case;

the acoustic generator according to claim 13 installed in the case; and an electronic circuit that is connected to the acoustic generator.

20. An electronic device comprising:

a case;

the acoustic generator according to claim 14 installed in the case; and an electronic circuit that is connected to the acoustic generator.

* * * * *